US005347819A

United States Patent [19]

Saji et al.

[11] Patent Number: 5,347,819

[45] Date of Patent: Sep. 20, 1994

[54] METHOD AND APPARATUS FOR MANUFACTURING SUPERFLUIDITY HELIUM

[75] Inventors: Nobuyoshi Saji, Saitama; Hiroshi Ohya, Chiba; Hiroshi Asakura; Shunji Nagai, both of Tokyo, all of Japan

[73] Assignee: Ishikawajima-Harima Heavy Industries, Co., Ltd., Tokyo, Japan

[21] Appl. No.: 141,742

[22] Filed: Oct. 27, 1993

[30] Foreign Application Priority Data

Nov. 5, 1992 [JP] Japan ..... 4-295538

[51] Int. Cl.[5] ..... F25B 19/00

[52] U.S. Cl. ..... 62/51.3; 62/434

[58] Field of Search ..... 62/9, 51.3, 434

[56] References Cited

U.S. PATENT DOCUMENTS

| | | | |
|---|---|---|---|
| 3,447,339 | 6/1969 | Rietdijk | 62/51.3 |
| 4,136,531 | 1/1979 | Staas et al. | 62/51.3 |
| 4,209,657 | 6/1980 | Inai et al. | 62/51.3 |
| 4,713,942 | 12/1987 | Hofmann | 62/51.3 |

*Primary Examiner*—Ronald C. Capossela

*Attorney, Agent, or Firm*—Cushman, Darby & Cushman

[57] ABSTRACT

Method and apparatus for manufacturing superfluidity helium (He II). The method includes the steps of (a) providing $^3$He gas (b) providing liquid $^4$He, (c) compressing the $^3$He gas to produce compressed $^3$He gas, (d) indirectly cooling the compressed $^3$He gas with liquid $^4$He to produce cryogenic $^3$He gas (e) adiabatically expanding the cryogenic $^3$He gas to produce cryogenic $^3$He gas having a temperature of less than about 1.18° K., preferably less than 1.8° K., and (f) indirectly cooling the liquid $^4$He with the cryogenic $^3$He gas produced in step (e) to produce superfluidity helium. The apparatus includes a first container for liquid helium and a second container for containing superfluidity helium, and a first line for connecting the first and second containers. A $^3$He refrigeration circuit is provided to cool the $^4$He in directly with cryogenic $^3$He to produce superfluidity helium. The method and apparatus enables superfluidity helium to be produced without the use of a large vacuum pump whose lubricants might contaminate the superfluidity helium. The method and apparatus also allow superfluidity helium at or near standard pressure to be easily produced and maintained.

30 Claims, 7 Drawing Sheets

METHOD AND APPARATUS FOR MANUFACTURING SUPERFLUIDITY HELIUM

BACKGROUND OF THE INVENTION

The present invention relates to a method and an apparatus for manufacturing superfluidity helium, and more particularly to a method and an apparatus for transforming liquid helium ("$^4$He") to superfluidity helium (He II) by indirectly cooling the liquid helium with cryogenic $^3$He gas.

Liquid helium has the lowest boiling point of all elements, and is transformed superfluidity helium (He II), a state having a quite different nature and different properties compared with liquid helium, by cooling the liquid helium to less than 2.18K (the so-called Z point). Superfluidity helium has, among other unique properties, the property of superfluidity, in which the liquid exhibits completely frictionless flow and can pass through extremely small holes with the greatest of ease. In addition, it is well known that superfluidity helium stabilizes the phenomenon of superconductivity (zero electrical resistance at cryogenic temperatures) due to its very high heat conductivity. Superfluidity helium is therefore well suited to be used for cooling the superconducting magnets used in large particle accelerators or test installations for nuclear fusion.

Heretofore, superfluidity helium (He II) has been manufactured by (1) liquefying helium gas to produce liquid helium at standard pressure and a temperature of 4.2K using a conventional Claude cycle refrigerator, (2) adiabatically expanding the liquid helium to a pressure of less than about 0.015 atm, and (3) cooling it using the Joule-Thomson effect to partially transform the helium to He II. However, this method requires the use of several large vacuum pumps (compression ratio: about 67) for compressing cryogenic gas of less than 0.015 atm to standard pressure (1 atm).

For improving the above prior art method, the "TORE SUPRA" in France has used the refrigerating apparatus shown in FIG. 7 (Prior Art). In this apparatus, the helium gas is compressed by a compressor 1 from 1 atm to about 15 atm, and cooled by heat exchangers 2, 3 and 4, respectively, using cryogenic helium of 77K, 13K and 4.2K formed by another Claude cycle refrigerator (not shown). The helium gas is then expanded to about 0.012 atm and cooled to 1.7K using a JT valve 5. Part of the cooled helium gas is transformed to superfluidity helium. The remaining non-liquified cryogenic helium gas is compressed to about 0.05 atm by a cryogenic temperature centrifugal vacuum pump 6, further compressed to 1 atm by a large normal temperature reciprocal vacuum pump 7, and finally returned to compressor 1.

However, in the method and the apparatus mentioned above, the pressure of the helium gas must be reduced to a low pressure vacuum state of less than about 0.015 atm since this method and apparatus cool the helium gas to less than 2.18K (the λ point), preferably less than 1.8K by using the helium's own adiabatic expansion. Accordingly, the use of a large vacuum pump is unavoidable.

In addition, since the compression ratio of the reciprocal vacuum pump 7 is high (about 20) and thus is liable to cause leakage of the helium gas, the pump 7 is sealed by using a lubricant which would cause contamination of the helium gas. Accordingly, it is necessary to provide a large purifier in order to maintain the helium gas at a high purity.

Furthermore, it is necessary to cool the superfluidity helium at standard or near standard atmospheric pressure. This helium is called "pressurized superfluidity helium" since it is pressurized higher than its boiling point vapor pressure. The standard pressure helium is cooled by a heat exchanger in order to obtain pressurized superfluidity helium, since the pressure of superfluidity helium obtained by the method and the apparatus of the prior art is substantially less than standard pressure (e.g., less than 0.015 atm). At a low pressure near the boiling point of the superfluidity helium, the superfluidity helium is immediately vaporized when the heat load is high and therefore sufficient cooling with the superfluidity helium cannot be achieved. Accordingly, the method of FIG. 7 (Prior Art) uses a method of (1) indirectly cooling the superfluidity helium (i.e., pressurized superfluidity helium) sealed at or near standard pressure, and (2) indirectly cooling a superconducting magnet 8 arranged at a remote place as shown in FIG. 7 using the very high superconducting characteristics of the pressurized superfluidity helium. The indirect cooling is conducted without circulating the pressurized superfluidity helium. However, this method has the problems (1) that the heat exchangers must be large due to the inferior heat conductivity of the helium gas in a low pressure vacuum state, and (2) that the cooling capability is limited due to the limited heat conductivity of the pressurized superfluidity helium.

It is an object of the present invention to provide a method and an apparatus for manufacturing superfluidity helium which can solve the above problems of the prior art.

Specifically, it is an object of the present invention to provide a method and an apparatus for manufacturing superfluidity helium which does not require a large vacuum pump and therefore can avoid the necessity of using a large purifier to remove contaminants from the helium gas caused by the lubricant of the vacuum pump.

It is another object to provide a method and an apparatus for manufacturing pressurized superfluidity helium which can cool a superconducting magnet by directly contacting the magnet with superfluidity helium or circulating superfluidity helium around the magnet.

SUMMARY OF THE INVENTION

In accordance with the above objects, the present invention provides a method for producing superfluidity helium comprising the steps of (a) providing $^3$He, (b) providing liquid $^4$He, (c) compressing the $^3$He to produce compressed $^3$He, (d) indirectly cooling the compressed $^3$He with liquid $^4$He to produce cryogenic $^3$He, (e) adiabatically expanding the cryogenic $^3$He to produce cryogenic $^3$He having a temperature of less than 2.18K, and (f) indirectly cooling the liquid $^4$He with the cryogenic $^3$He having a temperature of less than 2.18K to produce superfluidity helium. Preferably, the method also comprises the step of (g) maintaining the superfluidity $^4$He at a pressure of substantially 1 atm. The cryogenic $^3$He of steps (e) and (f) is preferably at a temperature of less than about 1.8K. Preferably, the cryogenic $^3$He is adiabatically expanded in step (e) to a pressure of less than about 200 Torr. The method also preferably comprises the step, after the step (d) of indirectly cooling the cooled $^3$He with $^3$He recycled after being used to produce superfluidity $^4$He in step (f).

In a further embodiment, the cryogenic $^3He$ of step (f) is recycled, after step (f), to step (c) to form a $^3He$ cycle in which the steps (c), (d), (e) and (f) are cyclically repeated.

In another preferred embodiment, after step (d) and before (f), steps (c) and (d) are repeated. In this manner, the cryogenic $^3He$ produced by step (d) is further compressed according to step (c) and a resulting compressed gas is further cooled according to step (d).

In another preferred embodiment, the step (b) of providing liquid $^4He$ comprises providing liquid $^4He$ in a first container, and providing liquid $^4He$ in a second container, wherein step (c) is conducted in the first container, and step (f) is conducted in the second container. The second container is preferably maintained at a pressure of substantially 1 atm.

In accordance with yet another embodiment of the present invention there is provided an apparatus for producing superfluidity helium. The apparatus comprises a first container for storing liquid $^4He$, a second container for storing superfluidity $^4He$, and a first line connecting the first and second containers. The apparatus also contains a $^3He$ refrigeration circuit including (a) a first compressor for compressing $^3He$, (b) a first heat exchanger, disposed downstream of the first compressor and located in the first container, for indirectly cooling compressed $^3He$ from the first compressor with liquid $^4He$ in the first container to produce cooled, compressed $^3He$, (c) means, disposed downstream of the first heat exchanger, for adiabatically expanding the cooled, compressed $^3He$ from the first heat exchanger to produce a cryogenic $^3He$, (d) a second heat exchanger, disposed downstream of the first heat exchanger and located in the second container, for indirectly cooling liquid $^4He$ in the second container in the cryogenic $^3He$ to produce superfluidity $^4He$, and (e) a second line connecting the second heat exchanger with the first compressor to form a $^3He$ refrigeration circuit.

In a preferred embodiment, the $^3He$ refrigeration circuit further comprises (f) a second compressor, disposed between the first heat exchanger the means for adiabatically expanding, to further compress the cooled, compressed $^3He$; (g) a third heat exchanger, disposed between the second compressor and the means for expanding and located in the first container, for further cooling the cooled compressed $^3He$, and (h) a fourth heat exchanger, disposed between the third heat exchanger and the means for expanding, for cooling $^3He$ in the second line indirectly with cooled, compressed $^3He$ from the third heat exchanger.

In another preferred embodiment the apparatus further comprises a third container for containing $^4He$, a third line connecting the first and third containers, and means, disposed in the third line, for adiabatically expanding liquid $^4He$ from the third container and introducing expanded liquid $^4He$ into the first container.

The first compressor (b) is preferably a centrifugal gas bearing or magnetic bearing compressor.

Further objects, features, and advantages of the present invention will become apparent from the Detailed Description of the Preferred Embodiments which follows, when considered together with the attached drawings.

DESCRIPTION OF THE PREFERRED EMBODIMENTS

Figure 1:
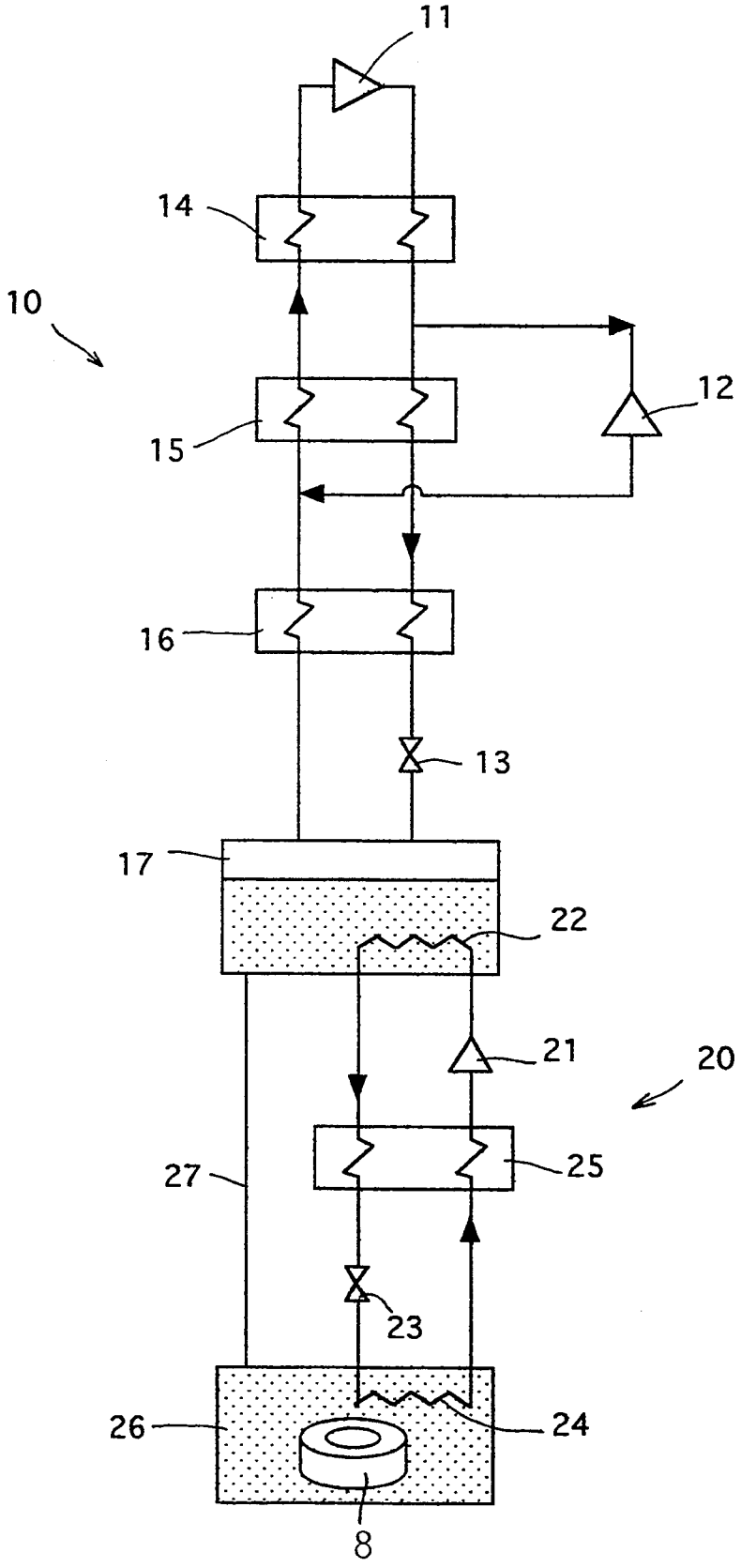
FIG. 1 is a schematic view showing the entire structure of an apparatus according to a first embodiment of the present invention.

Liquid helium has the lowest boiling point of all elements. Helium has two isotopes, $^4He$ (normal helium) and $^3He$. Although $^4He$ must be decompressed to less than about 0.015 atm in order to cool the it to less than 2.18K (the $\lambda$ point), e.g., 1.8K., its isotope $^3He$ can reach the same temperature at about 0.11 atm pressure. The present invention therefore solves the problems of the methods and apparatuses of the prior art by utilizing the differences in the characteristics of the $^3He$ isotope.

That is, according to the method of the present invention summarized above, the gas of the $^3He$ helium isotope is compressed from about 0.11 atm to about 0.5–2.0 atm, the compressed $^3He$ gas is indirectly cooled by liquid $^4He$, the cooled $^3He$ gas is adiabatically expanded to about 0.11 atm to cool it to less than 1.8K, and the liquid $^4He$ is indirectly cooled by the $^3He$ gas of less that 2.18K less than 1.8K, and the $^3He$ gas whose temperature has been increased by the heat exchangers is returned to the compressor with maintaining its pressure at about 0.11 atm.

The method and apparatus of the present invention can manufacture superfluidity helium (He II) by easily cooling the liquid $^4He$ helium with cryogenic $^3He$ gas. Also, according to the present invention a large vacuum pump using lubricant for sealing purposes is not required since the $^4He$ is treated at standard pressure or greater. The compression of the $^3He$ gas from about 0.11 atm may carried out by a cryogenic temperature compressor using gas or magnetic bearings. Accordingly it is possible to prevent the helium gas from being contaminated by lubricant from the vacuum pump and to eliminate need for using a large purifier.

Further, according to the present invention, since superfluidity helium is manufactured by indirectly cooling the liquid helium at or near standard pressure with the $^3He$ of preferably less than 1.8K, it is possible to manufacture and maintain superfluidity helium at or near standard pressure (called pressurized superfluidity helium).

Preferred embodiments of the present invention will be hereinafter described with reference to the accompanying drawings in which like structural components are designated by the same reference numerals.

Figure 2:
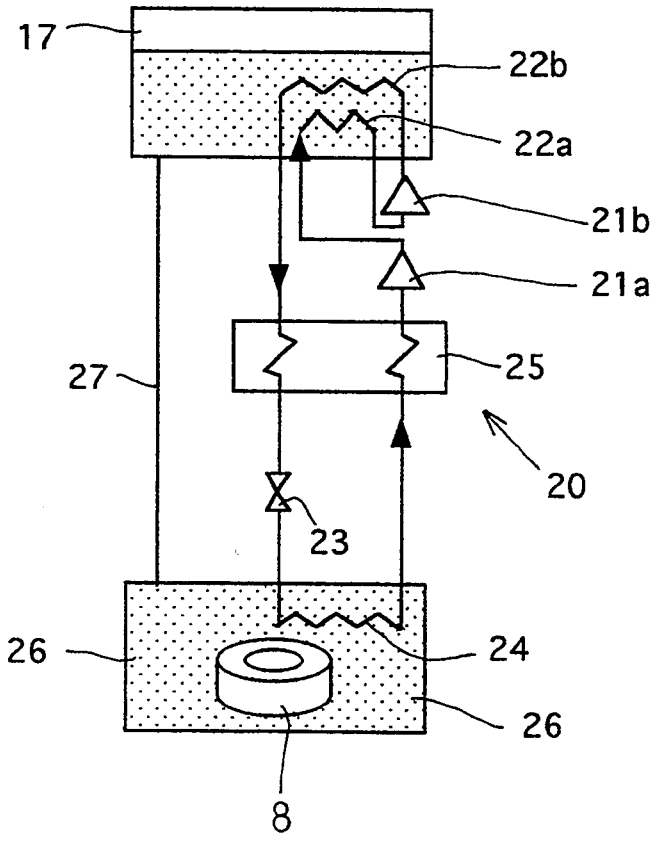
FIG. 2 is a schematic view showing a part of the structure of an apparatus according to a second embodiment of the present invention.
Figure 3:
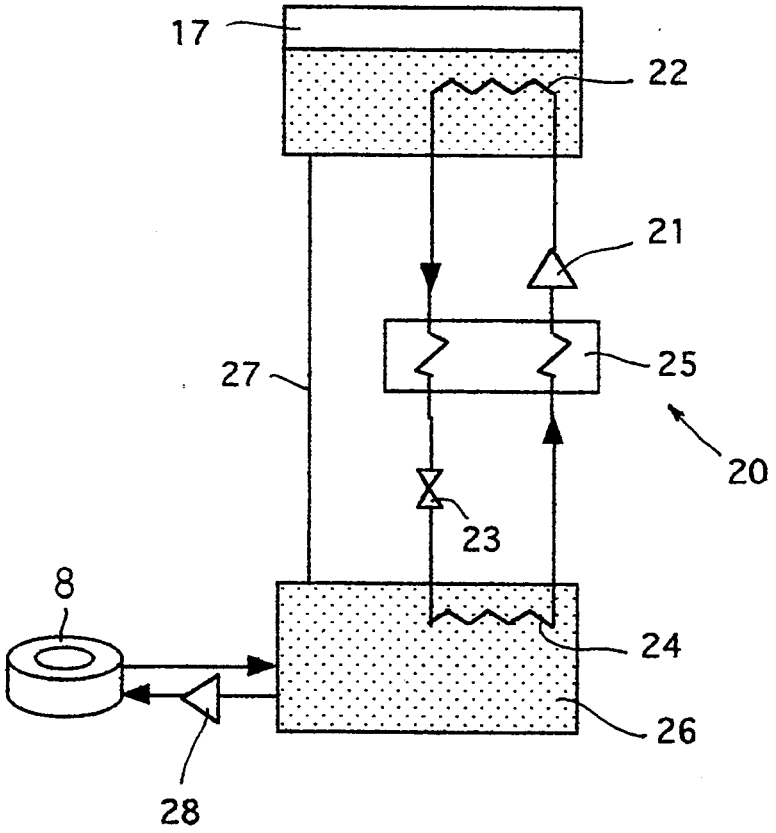
FIG. 3 is a schematic view showing a part of the structure of an apparatus according to a third embodiment of the present invention.

FIG. 1 is a schematic view showing the entire structure of an apparatus for manufacturing superfluidity helium according to a first embodiment of the present invention. FIGS. 2 and 3 are schematic views showing part of the structure of the apparatus according to other preferred embodiments.

In FIG. 1, the apparatus of the present invention comprises a refrigeration circuit or refrigerator 10 which produces liquid ($^4$He) helium (hereinafter referred to as "liquid $^4$He") by liquefying helium ($^4$He) gas (hereinafter referred to as "$^4$He gas") using the Claude cycle. The refrigeration circuit or refrigerator 10 includes a compressor 11, an expander 12, an expansion valve 13, coolers or heat exchangers 14, 15 and 16, and a container 17 for liquid helium. The heat exchangers 14, 15 and 16 use cryogenic $^4$He gas in a return side of circuit 10 returning from container 17, to cool $^4$He gas on a feed side of circuit 10 feeding into container 17. The circuit 10 pressurizes $^4$He gas of nearly standard temperature and pressure (1 atm and 300K) to 10–20 atm with compressor 11. The pressurized $^4$He gas is then cooled in heat exchanger 14 with $^4$He gas returning from container 17 over heat exchangers 16 and 15, respectively. Part of the pressurized $^4$He gas leaving heat exchanger 14 is expanded with expander 12 to produce cryogenic $^4$He gas. The expanded $^4$He gas is fed into the return side of the circuit 10 upstream of heat exchanger 15. Lower temperature cryogenic $^4$He gas is produced using the expanded cryogenic $^4$He gas and cryogenic $^4$He gas circulated from liquid helium container 17 over heat exchanger 16. The lower temperature cryogenic $^4$He gas leaving heat exchanger 16 (less than about 6K) is further cooled by being adiabatically expanded by expansion valve 13. Part of this $^4$He gas is then transformed to liquid helium in container 17 at standard pressure and a temperature of 4.2K.

Cryogenic $^4$He gas not transformed to liquid $^4$He in container (7) is returned on the return side of refrigeration circuit or refrigerator 10, consecutively, over heat exchangers 16, 15 and 14 to compressor 11. The number of expanders and heat exchangers provided may be increased, if necessary. Helium container 17 is connected to another helium container 26 by means of line 27.

The apparatus of the present invention further comprises a $^3$He refrigeration circuit or refrigerator 20. The circuit includes a $^3$He compressor 21 for compressing helium gas of the $^3$He isotope (hereinafter referred to as "$^3$He gas"), a cooler 22 for indirectly cooling the compressed $^3$He gas with liquid $^4$He in container 17, a $^3$He expansion valve 23 for adiabatically expanding the cooled $^3$He gas to cool it to less than 2.18K, and a He-II-producing cooler 24 for indirectly cooling the liquid $^4$He to a temperature of less than 2.18K to transform the liquid $^4$He to superfluidity helium in container 26.

As is shown in FIG. 1, superfluidity helium container 26 may contain an object to be cooled such as a superconducting electromagnet 8.

In order to substantially prevent the gas from being contaminated by lubricant leaking from the vacuum pump compressor 21, compressor 21 may be a centrifugal compressor using lubricant-free dynamic pressure gas bearings or lubricant-free magnetic bearings. The $^3$He compressor 21 is thus a perfectly oil-free and lubricant-free compressor for aspirating and compressing cryogenic gas.

Referring to FIG. 2, in a second embodiment of the present invention, it is also possible to provide two $^3$He compressors 21*a* and 21*b* along with two $^4$He coolers 22*a* and 22*b*. In this arrangement, $^3$He gas discharged from $^3$He compressor 21*a* is cooled by $^4$He cooler 22*a*, and then further compressed by a $^3$He compressor 21*b* before being further cooled by cooler 22*b*. The arrangement of the second embodiment makes it possible to increase the compression ratio of the compressor, to improve the cycle efficiency, and to increase the cooling capacity of the apparatus.

The $^3$He expansion valve 23 is a so-called JT valve for adiabatically expanding the $^3$He gas to lower the temperature of the gas by the Joule-Thomson effect. The pressure of the $^3$He gas expanded by the $^3$He expansion valve 23 is less than about 200 Torr, preferably less than about 100 Torr. This arrangement it possible to build a refrigeration cycle using the $^3$He gas as a refrigerant and obtain a cryogenic temperature less than the $\lambda$ point of 2.18K, preferably less than 1.8K. The cryogenic $^3$He is then used to cool liquid $^4$He in container 26.

The embodiment of FIG. 2 further comprises a $^3$He heat exchanger 25 for indirectly cooling pre-expansion $^3$He gas from cooler 22*b* with post-expansion $^3$He gas returning from cooler 24. The use of heat exchanger 25 enables a further increase in the efficiency of the $^3$He refrigeration circuit 20.

Container 26 for $^4$He superfluidity helium is connected by a line 27 with liquid helium container 17. At least one of the containers 17 and 26 is maintained at standard pressure (e.g., 1 atm). Preferably container 26 is maintained at standard pressure. Liquid helium container 17 contains liquid $^4$He helium at 4.2K and 1 atm. Superfluidity helium container 26 also contains liquid $^4$He helium at 4.2K and 1 atm pressure at the beginning of the operation of the refrigeration circuit 20. The liquid $^4$He helium in container 26 is cooled indirectly by $^3$He gas of preferably less than 1.8K in cooler 24, as mentioned above. The liquid $^4$He in container 26 is then transformed to superfluidity $^4$He helium of preferably about 1.8K and 1 atm.

A superconducting magnet 8 can be directly cooled if it is contained in superfluidity container 26 as shown in FIGS. 1 and 2. In these embodiments, means for containing the magnet 8 would be provided in container 26. A superconducting magnet 8 can also be forcedly cooled by circulating the superfluidity helium around the magnet 8 using a circulating pump 28, or other means for conducting superfluidity helium from container 26, as shown in FIG. 3.

In the apparatus according to FIG. 1, the refrigeration circuit or refrigerator 10 pressurizes the $^4$He gas of near standard temperature and pressure (1 atm, 300K) to 10–20 atm with compressor 11. The compressed gas is cooled in heat exchanger 14. Part of this pressurized $^4$He gas is then expanded by expander 12 to produce cryogenic $^4$He gas. This cryogenic gas is fed to the return side of the circuit 10 upstream of heat exchanger 15, along with $^4$He gas returning over heat exchanger 16 from liquid helium container 17. After being further cooled in heat exchanger 16 by returning gas from container 17, lower temperature cryogenic $^4$He gas (e.g., less than about 6K) is produced. The lower temperature cryogenic $^4$He gas is adiabatically expanded by expansion valve 13. Part of the expanded gas is transformed to liquid helium of standard pressure and at a temperature of about 4.2 K.

In $^3$He refrigeration circuit or refrigerator 20, $^3$He gas is compressed by $^3$He compressor 21. The compressed $^3$He gas then flows into cooler 22 and is indirectly cooled by liquid $^4$He in container 17. The thus-cooled $^3$He gas is later adiabatically expanded by valve 23 and cooled to less than 2.18K. Finally, the liquid $^4$He helium is transformed to superfluidity $^4$He helium in container 26 by indirect cooling of liquid $^4$He helium with $^3$He gas of less than 2.18K in cooler 24.

$^3$He gas at a temperature of about 4K and a pressure of about 0.11 atm is input into $^3$He compressor 21, compressed and output at a pressure of 1.5 to 2 atm. The heat generated by compression is exchanged by cooler 22 in liquid helium container 17. The $^3$He gas from cooler 22 is then further cooled by heat exchanger 25 with cryogenic $^3$He gas from a return side of circuit 20 returning from cooler 24. The $^3$He gas is finally adiabatically expanded by a JT valve or $^3$He expansion valve 23 and cooled to about 1.7K. Pressurized superfluidity $^4$He helium at a temperature of about 1.8K and a pressure of about 1 atm can be thus manufactured by exchanging the heat of the liquid $^4$He helium in the superfluidity helium container 26 with the $^3$He gas expansion-cooled to about 1.7K by valve 23.

Figure 4:
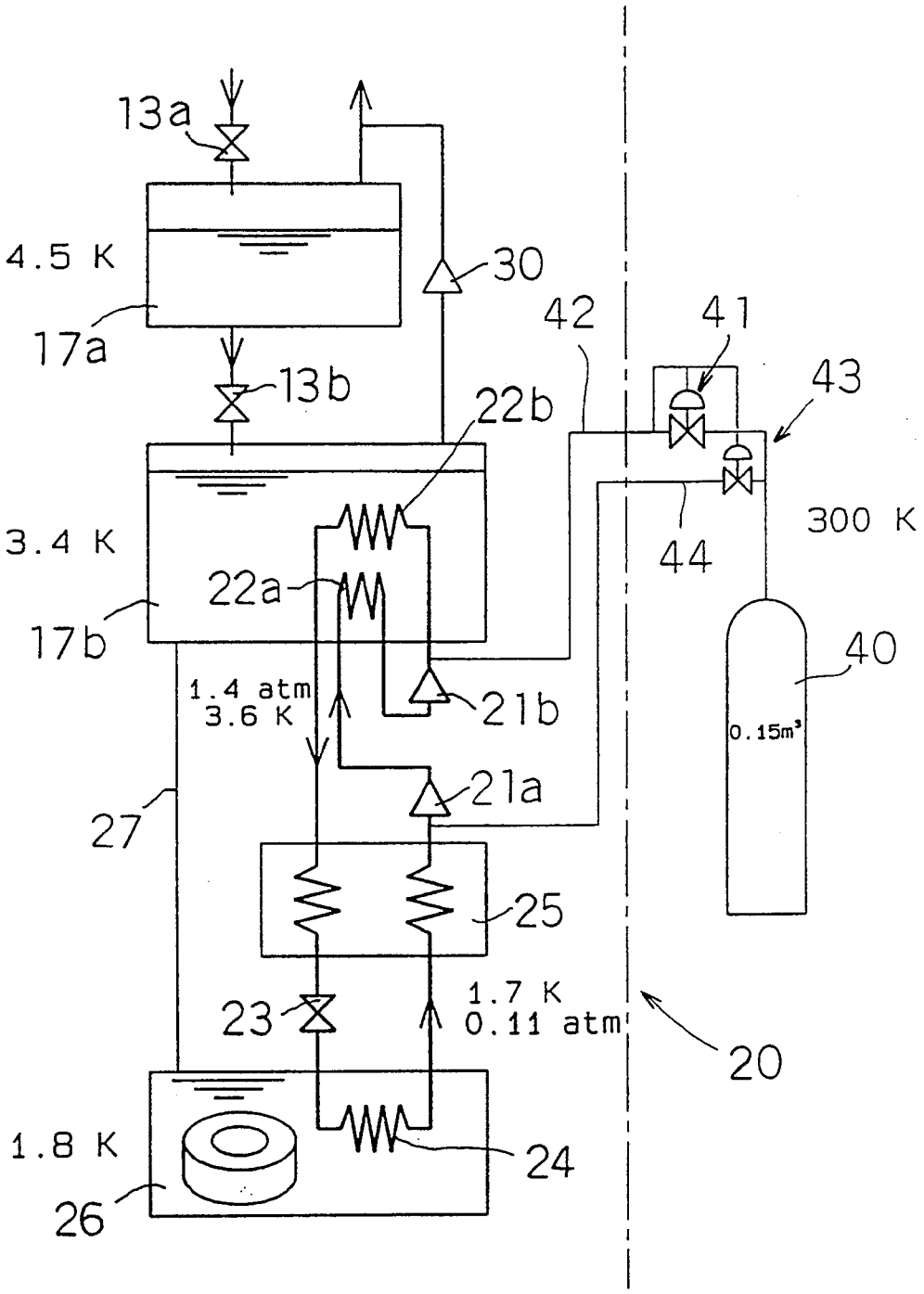
FIG. 4 is a schematic view showing a part of the structure of an apparatus according to a fourth embodiment of the present invention.
Figure 5:
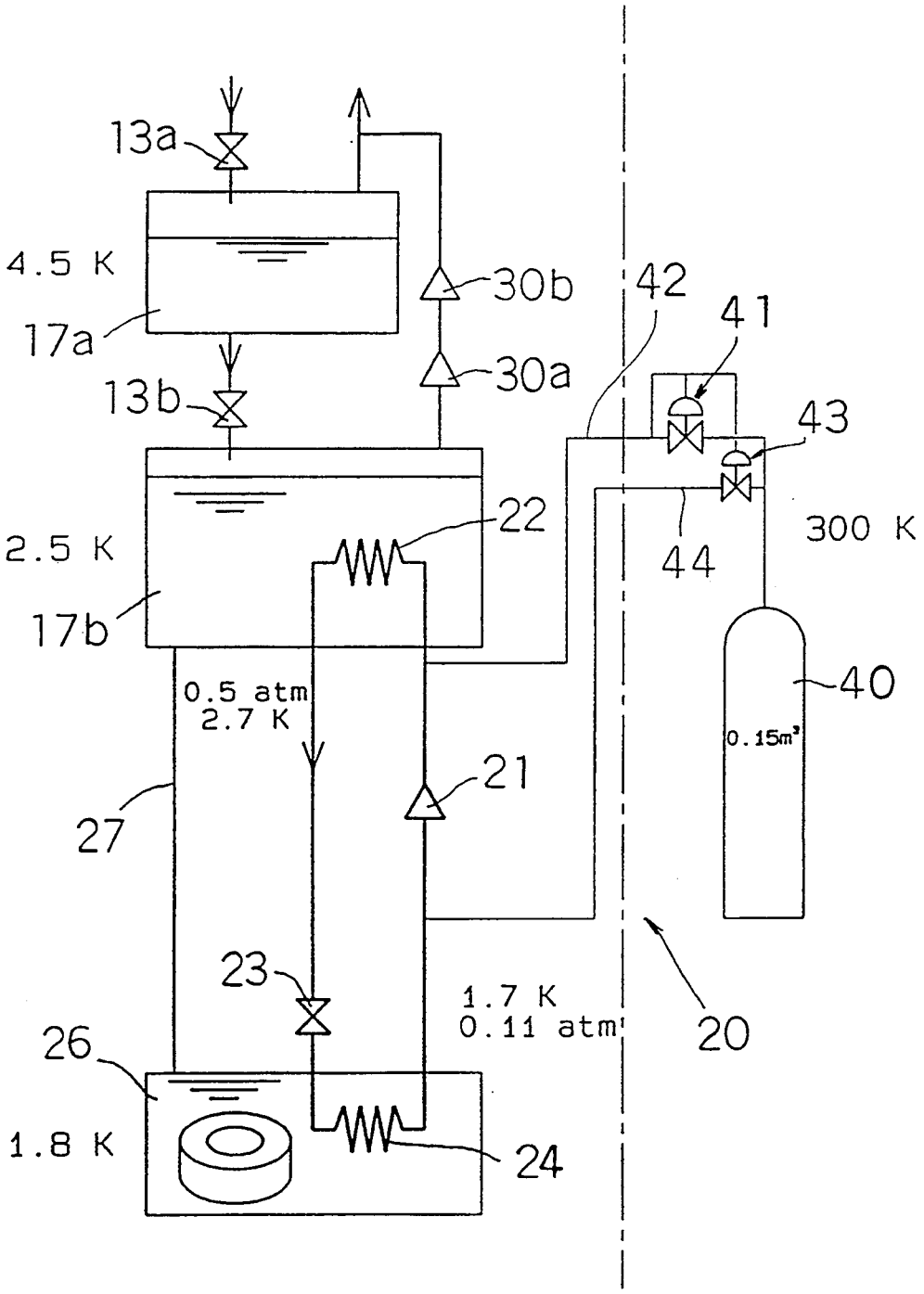
FIG. 5 is a schematic view showing a part of the structure of an apparatus according to a fifth embodiment of the present invention.
Figure 6:
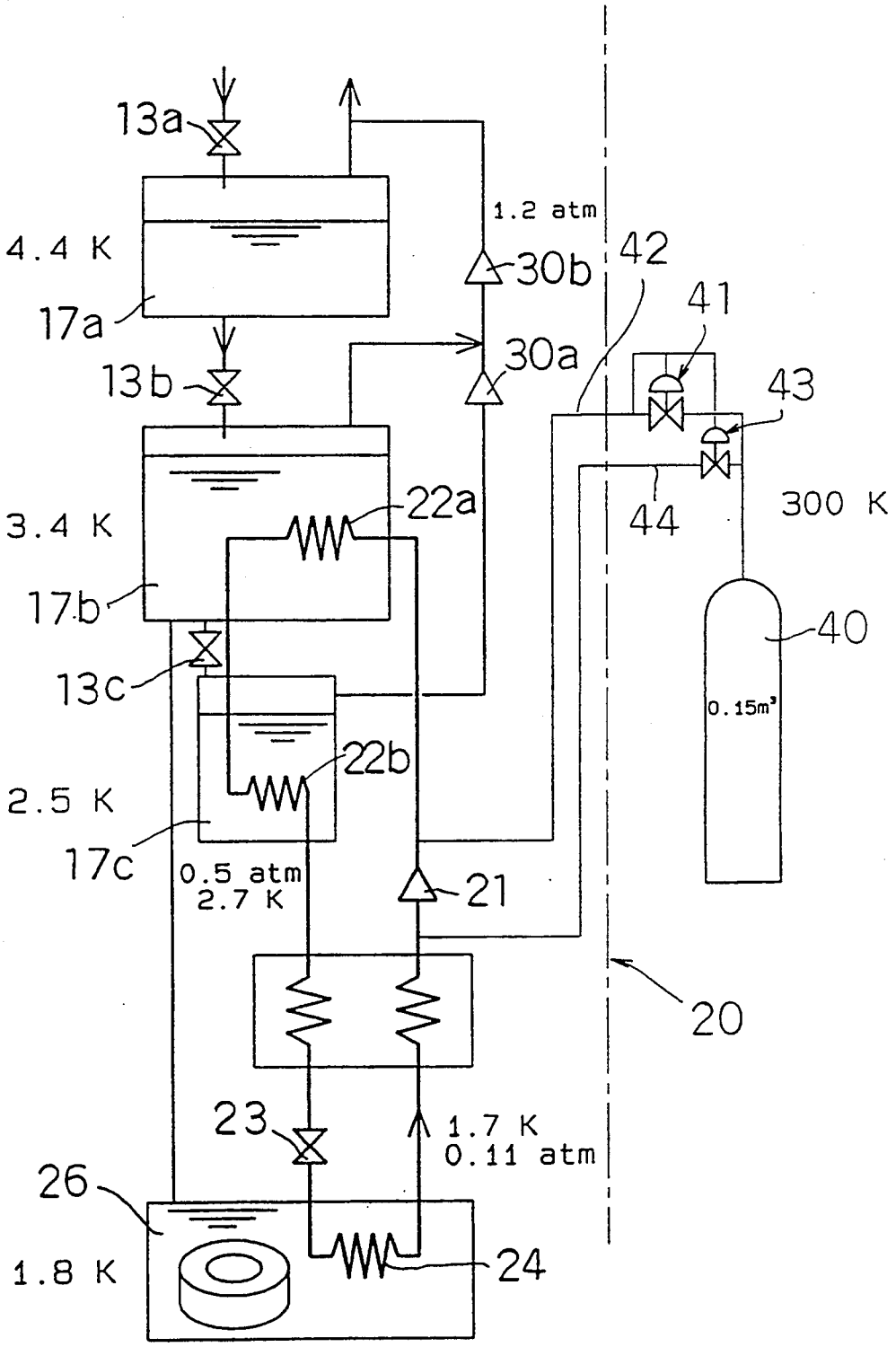
FIG. 6 is a schematic view showing a part of the structure of an apparatus according to a sixth embodiment of the present invention.
Figure 7:
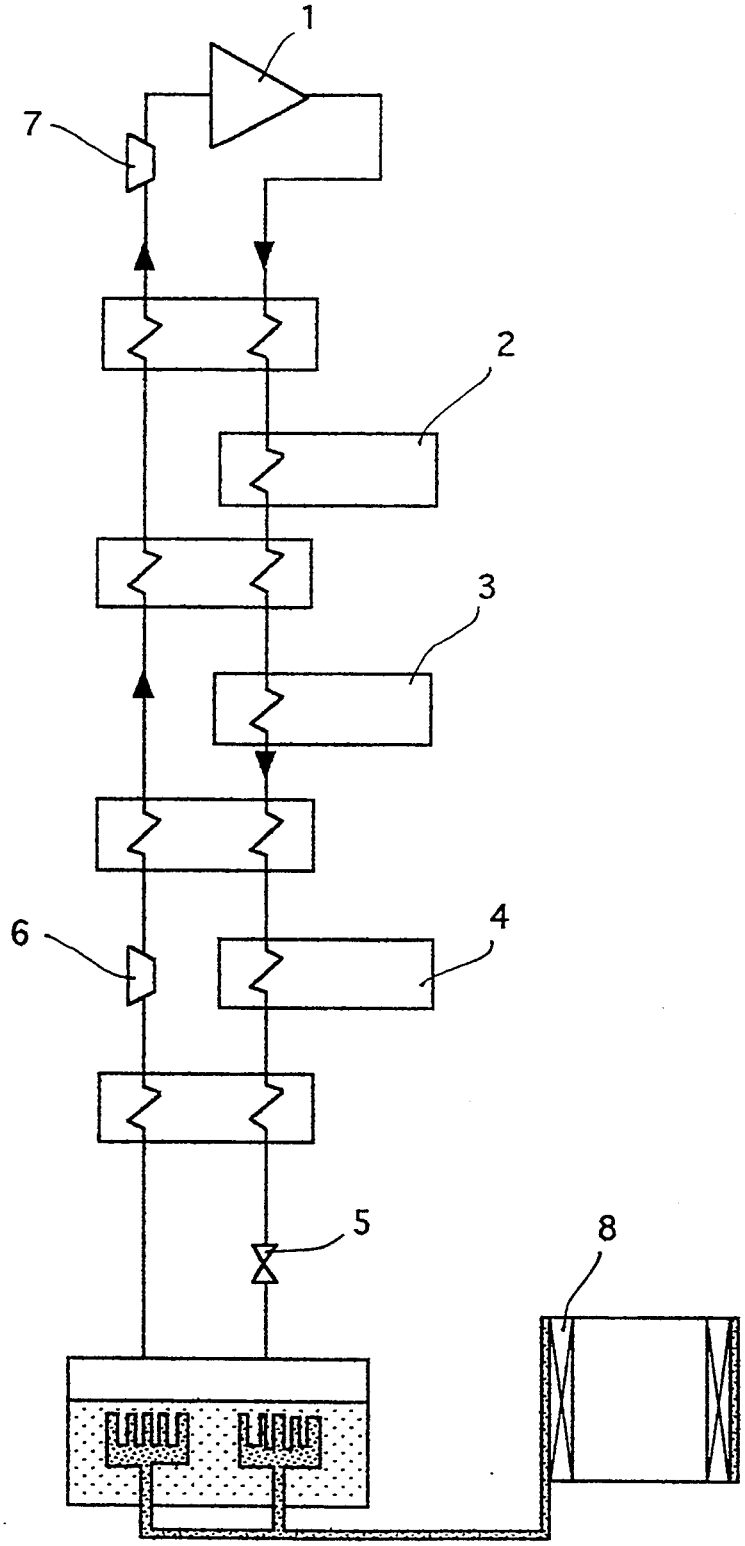
FIG. 7 (Prior Art)
FIG. 7 is a schematic view showing the entire structure of an apparatus according to the prior art.

FIGS. 4 to 6 show parts of the structures of fourth, fifth and sixth embodiments, respectively, of the apparatus for manufacturing the superfluidity helium $^4$He according to the present invention. In these drawings, structural components in common with the embodiments of FIGS. 1 to 3 are designated by the same reference numerals.

In the fourth embodiment shown in FIG. 4, the liquid $^4$He helium container 17 as shown in FIG. 1 is separated into a container 17*a* of near standard pressure and a container 17*b* at less than standard pressure. In addition, a $^4$He expansion valve 13*b* is provided in a line connecting containers 17*a*, 17*b* for expanding the liquid $^4$He helium in container 17*a* and introducing it into the container 17*b*. The liquid $^4$He in container 17*a* which may have a temperature of about 4.4K, is thus cooled to about 3.4K. A $^4$He compressor 30 is provided for compressing the $^4$He gas evaporated in container 17*b* and supplying the $^4$He gas, along with $^4$He gas evaporated in container 17*a* to an upstream heat exchanger (not shown). Preferably, the pressure in container 17*b* is less than about 0.4 atm.

In this fourth embodiment, two $^3$He compressors 21*a* and 21*b*, and two $^4$He coolers 22*a* and 22*b* are provided in a $^3$He refrigeration circuit 10 in a manner similar to the second embodiment shown in FIG. 2. Lines 42, 44 serve to feed $^3$He from a bomb 40 shown at the right side of FIG. 4 to the $^3$He refrigeration circuit 20. Valves 41, 43, are disposed in feed lines 42, 44, respectively.

The arrangement of FIG. 4 enables the temperature of the liquid $^4$He in container 17*b* to be lowered to about 3.4K. The outlet pressure of the $^3$He compressor 21*b* may be about 1.4 atm, and the compression ratio obtained by the two $^3$He compressors 21*a* and 21*b* may be low (about 13 in this embodiment). In addition, as the outlet pressure of $^3$He compressor 21*b* is lowered, this enables the amount of expensive $^3$He gas necessary for the apparatus to be reduced to less than one half without lowering the capacity of the apparatus.

FIG. 5 shows a fifth embodiment which is a modification of the embodiment of FIG. 4 in which the $^4$He compressor is formed by two $^4$He compressors 30*a* and 30*b*. The $^3$He compressor 21 and the $^3$He cooler 22 are similar to those in the first embodiment of FIG. 1. The arrangement of FIG. 5 enables the pressure within container 17*b* to be lowered to about 0.1 atm and the temperature of the liquid $^4$He within container 17*b* to be lowered to about 2.5K from a temperature of about 4.5K in container 17*a*. Accordingly, the outlet pressure of $^3$He compressor 21 can be lowered to about 0.5 atm and the compression ratio of $^3$He compressor 21 can be further reduced (about 4.5 in this embodiment). In this embodiment, compressed $^3$He gas at 0.5 atm and 2.7K is expanded by valve 23 to cryogenic $^3$He gas of about 0.11 atm and 1.7K. In addition, the amount of expensive $^3$He gas necessary for the apparatus of this embodiment can be further reduced without lowering the capacity of the apparatus.

FIG. 6 shows a sixth embodiment of the present invention which is modification of the fifth embodiment of FIG. 5. The sixth embodiment comprises a $^4$He container 17*c* having an inside pressure lower than that of container 17*b*. A $^4$He expansion valve 13*b* expands the 4.4K liquid $^4$He from container 17*a*, and introduces a cooled liquid $^4$He of about 3.4K into container 17*b*. A $^4$He expansion valve 13*c* expands the liquid $^4$He in container 17*b* before it is introduced into the $^4$He container 17*c*. The liquid $^4$He at 3.4K in container 17, can thus be cooled to about 2.5K in container 17*c*. $^4$He compressors 30*a* and 30*b* are provided for compressing the $^4$He gas in third container 17*c* and supplying it to containers 17*a* and 17*b*, or to an upstream part of the $^4$He refrigeration circuit 10 (not shown).

The $^3$He refrigeration circuit 20 comprises a cooler 22*a* disposed in container 17*b* and a cooler 22*b* disposed in container 17*c*. This arrangement enables the cycle efficiency of the $^3$He refrigeration circuit 20 to be improved.

In the embodiments of FIGS. 1 to 6, the $^3$He gas is preferably a mixed gas including $^4$He gas. The use of the mixed gas enables the $^4$He gas contained in the $^3$He gas to be liquified in the heat exchanger 24 and to be transformed to superfluidity helium (He II). This transformation promotes heat conduction in the $^3$He heat exchanger because of the superior heat conduction of superfluidity helium.

According to the present invention all problems found in the prior art methods and apparatuses for making superfluidity helium can be solved at once taking advantage of the differences in the characteristics of the $^3$He isotope.

That is, the apparatus of the present invention does not require a large vacuum pump since the $^4$He is always transformed to superfluidity helium at standard pressure or above. Moreover, the compression of the $^3$He from about 0.11 atm is carried out by a compressor using the gas or magnetic bearings. Accordingly, it is possible to substantially prevent the $^4$He gas from being contaminated by lubricant from the vacuum pump, and thus no large purifier is required.

Since the superfluidity $^4$He is manufactured by indirectly cooling the liquid $^4$He of at or near standard pressure using $^3$He of preferably less than about 1.8K, it is possible to easily manufacture and maintain the superfluidity $^4$He at or near standard pressure.

Thus, in summary, according to the present invention, a large vacuum pump is not required, and the amount of the expensive $^3$He gas needed to charge the apparatus can be greatly reduced. Also, according to the present invention, it is possible to provide an apparatus for manufacturing superfluidity helium which can prevent the helium gas from being contaminated by lubricant from the vacuum pump, and therefore does not require a large purifier.

Also, according to the present invention, it is possible to manufacture pressurized superfluidity helium which can cool a superconducting magnet either by directly contacting the magnet with superfluidity helium at or near standard pressure, or by circulating superfluidity helium around the magnet.

Although the present invention has been illustrated with respect to several preferred embodiments, one of ordinary skill in the art will recognize that modifications and improvements can be made while remaining within the scope and spirit of the present invention. The scope of the present invention is determined solely by the appended claims.

What is claimed is:

1. A method for producing superfluidity helium comprising the steps of:

(a) providing cryogenic $^3$He;

(b) providing liquid $^4$He in a first container;

(c) compressing the cryogenic $^3$He to produce compressed $^3$He;

(d) indirectly cooling the compressed $^3$He with liquid $^4$He in said first container to produce cryogenic $^3$He;

(e) adiabatically expanding the cryogenic $^3$He to produce cryogenic $^3$He having a temperature of less than 2.18° K.; and (f) indirectly cooling the liquid $^4$He in a second container with the cryogenic $^3$He produced by step (e) to produce superfluidity helium.

2. A method according to claim 1, further comprising the step of (g) maintaining said superfluidity $^4$He substantially at a pressure of 1 atm.

3. A method according to claim 1, wherein, said cryogenic $^3$He produced in step (e) has a temperature of less than about 1.8° K.

4. A method according to claim 1, wherein, in step (e), said cooled cryogenic $^3$He is adiabatically expanded to a pressure of less than about 200 Torr.

5. A method according to claim 1, further comprising the step, after said step (d) , of indirectly cooling said cooled $^3$He with $^3$He recycled after being used to produce superfluidity $^4$He in said step (f).

6. A method according to claim 5, wherein, after step (d) and before said step of indirectly cooling, the steps (c) and (d) are repeated, so that said cooled, cryogenic $^3$He produced by step (d) is further compressed according to step (c) and a resulting compressed gas is further cooled according to step (d).

7. A method according to claim 6, further comprising the step of maintaining the second container at a pressure of substantially 1 atm.

8. A method according to claim 1, wherein said step (b) comprises producing the liquid $^4$He using a Claude cycle process.

9. A method according to claim 1 wherein said $^3$He comprises a mixture of $^3$He and $^4$He.

10. A method according to claim 1, wherein said cryogenic $^3$He of step (f) is recycled, after step (f), to step (c) to form a $^3$He cycle wherein steps (c), (d), (e), and (f) are cyclically repeated.

11. A method according to claim 1, wherein, after step (d) and before step (f), steps (c) and (d) are repeated, so that said cryogenic $^3$He produced by step (d) is further compressed according to step (c) and a resulting compressed gas is further cooled according to step (d).

12. A method according to claim 11, further comprising the step of maintaining the second container at a pressure of substantially 1 atm.

13. A method according to claim 1, further comprising the step of maintaining the second container at a pressure of substantially 1 atm.

14. A method according to claim 1, wherein step (b) further comprises providing liquid $^4$He in a third container, and said method further comprises the steps of expanding liquid $^4$He from the third container to form expanded liquid $^4$He, and providing the expanded liquid $^4$He to the first container.

15. A method according to claim 14, further comprising the step of maintaining said second container at a pressure of about 0.4 atm.

16. A method according to claim 14, wherein said step (b) further comprises providing a fourth container, and wherein said method further comprises the steps of:

expanding liquid $^4$He from the first container to produce expanded liquid $^4$He, and providing the expanded liquid $^4$He from the first container to the fourth container;

the step, after step (d) and before step (e), of indirectly cooling said cryogenic $^3$He produced by step (d) with liquid $^4$He in the fourth container to produce further cooled cryogenic $^4$He gas;

recycling $^3$He used in step (f) to step (c), and cyclically repeating steps (c), (d), (e) and (f); and indirectly cooling $^3$He recycled from step (f) with further cooled cryogenic $^3$He produced by indirect cooling in the fourth container.

17. An apparatus for producing superfluidity helium, comprising:

a first container for storing liquid $^4$He;

a second container for storing superfluidity $^4$He;

a first line connecting the first and second containers; and a $^3$He refrigeration circuit including (a) a first compressor for compressing $^3$He, (b) a first heat exchanger, disposed downstream of the first compressor and located in the first container, for indirectly cooling compressed $^3$He from the first compressor with liquid $^4$He in the first container to produce cooled, compressed $^3$He, (c) means, disposed downstream of the first heat exchanger, for adiabatically expanding the cooled, compressed $^3$He from the first heat exchanger to produce a cryogenic $^3$He, and (d) a second heat exchanger, disposed downstream of the first heat exchanger and located in the second container, for indirectly cooling liquid $^4$He in the second container with the cryogenic $^3$He to produce superfluidity $^4$He, and (e) a second line connecting the second heat exchanger with the first compressor to form a $^3$He refrigeration circuit.

18. An apparatus according to claim 17, where said means (c) comprises a JT valve.

19. An apparatus according to claim 17, wherein said $^3$He refrigeration circuit further comprises:

(f) a second compressor, disposed between the first heat exchanger and the means for adiabatically expanding, to further compress said cooled compressed $^3$He;

(g) a third heat exchanger, disposed between the second compressor and the means for adiabatically expanding and located in the first container, for further cooling the cooled, compressed $^3$He; and (h) a fourth heat exchanger, disposed between the third heat exchanger and the means for adiabatically expanding, for cooling $^3$He in the second line indirectly with cooled, compressed $^3$He from the third heat exchanger.

20. An apparatus according to claim 19, further comprising:

a third container for containing $^4He$;

a third line connecting the third container with said first container; and means, disposed in the third line, for expanding liquid $^4He$ from the third container and introducing expanded liquid $^4He$ into said first container.

21. An apparatus according to claim 17, further comprising:

(h) an additional heat exchanger disposed between the first heat exchanger and the means for adiabatically expanding, for cooling $^3He$ in the second line indirectly with cooled, compressed $^3He$ from the first heat exchanger.

22. An apparatus according to claim 21, further comprising:

a third container for containing $^4He$;

a line connecting the third container with said first container; and means for expanding liquid $^4He$ from the third container and introducing expanded liquid $^4He$ into said first container.

23. An apparatus according to claim 22, further comprising:

a fourth container for containing liquid $^4He$;

a fourth line connecting said first container with the fourth container; and means, disposed in the fourth line, for expanding liquid $^4He$ from the first container and introducing expanded liquid $^4He$ into the fourth container; and wherein said $^3He$ refrigeration circuit further comprises (g) a third heat exchanger disposed in the $^3He$ circuit between the first heat exchanger and the additional heat exchanger, and located in the fourth container, for further cooling cooled, compressed $^3He$ from the first heat exchanger with liquid $^4He$ in the fourth container.

24. An apparatus according to claim 17, further comprising:

a third container for containing $^4He$;

a third line connecting the first and third containers; and means, disposed in the third line, for adiabatically expanding liquid $^4He$ from the third container and introducing expanded liquid $^4He$ into said first container.

25. An apparatus according to claim 17, further comprising means for containing an object to be cooled by said superfluidity helium within said second container.

26. An apparatus according to claim 25, wherein said object is a superconducting electromagnet.

27. An apparatus according to claim 26, wherein said object is an electromagnet.

28. An apparatus according to claim 17, further comprising means for conducting superfluidity helium from said second container to an object to be cooled by said superfluidity helium.

29. An apparatus according to claim 17, wherein the first compressor is a centrifugal gas bearing compressor.

30. An apparatus according to claim 17, wherein the first compressor is a centrifugal magnetic bearing compressor.

* * * * *